US005799716A

United States Patent [19]

Yamaguchi et al.

[11] Patent Number: 5,799,716

[45] Date of Patent: Sep. 1, 1998

[54] ELECTRIC-POWERED SHUTTER APPARATUS FOR A BUILDING OPENING

[75] Inventors: Kenji Yamaguchi; Tadashi Sasaki; Akira Koyano; Kenji Hosoyama, all of Tokyo, Japan

[73] Assignee: Sanwa Shutter Corporation, Tokyo, Japan

[21] Appl. No.: 780,009

[22] Filed: Dec. 23, 1996

[30] Foreign Application Priority Data

Dec. 28, 1995 [JP] Japan ..... 7-353065

[51] Int. Cl.[6] ..... A47G 5/02

[52] U.S. Cl. ..... 160/310; 160/291; 192/56.1; 192/71

[58] Field of Search ..... 160/310, 8, 1, 160/323.1, 291, 300, 302; 192/71, 56.1

[56] References Cited

U.S. PATENT DOCUMENTS 2,637,987 5/1953 Hill et al. ..... 192/56.1 X 2,930,212 3/1960 Walterscheid-Muller et al. .... 192/56.1 X 3,731,773 5/1973 Austin et al. ..... 192/56.1 X 4,766,641 8/1988 Daglow ..... 192/56.1 X

*Primary Examiner*—Blair Johnson

*Attorney, Agent, or Firm*—Nikaido, Marmelstein, Murray & Oram LLP

[57] ABSTRACT

An electric-powered shutter apparatus to be mounted to a building. A winding drum (4) of an electric-powered shutter device (1) is provided with a driving mechanism including an electric motor (7) and a single-directional rotary clutch device (8). A balance tension device (9) is provided at the other end of the apparatus. The clutch device (8) is configured to slip when the load of the rotation in the direction of the curtain being fed exceeds a certain load. Further, the load at which the clutch device (8) slips is set so as to be greater than the force for forcibly rotating the electric motor when disconnected from electric power. The balancing tension device (9) is balanced against the sum of the weight of the shutter curtain (2) and the load for forcibly rotating the electric motor (7). Thus, the need for a braking device for the electric-powered shutter apparatus to be mounted to a building is eliminated.

1 Claim, 3 Drawing Sheets

Fig.3
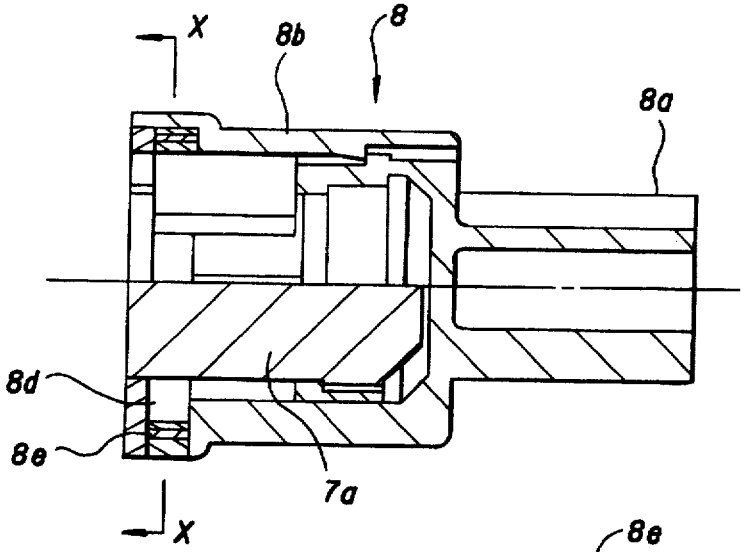
Fig.4
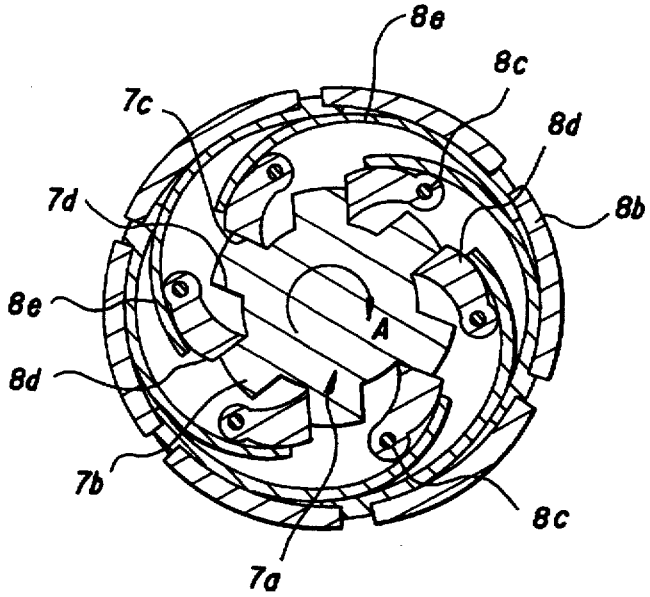
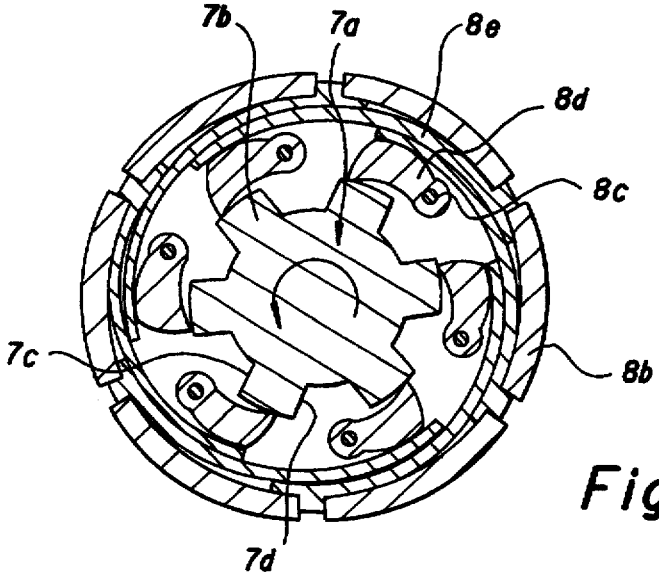
Fig.5

ELECTRIC-POWERED SHUTTER APPARATUS FOR A BUILDING OPENING

BACKGROUND OF THE INVENTION

The present invention relates to electric-powered shutter apparatuses for buildings, to be mounted to cover openings in buildings such as windows or entrances.

Generally, an electric-powered shutter apparatus is constructed to have an electric motor as the driving means, and a brake device which is activated so as to stop any motion of the apparatus when the electric motor is disconnected from electric current. This prevents undesired opening or shutting operation of the shutter curtain.

However, with such a configuration, in the event of emergency such as a power outage, opening or shutting of the shutter curtain requires the troublesome procedure of setting the brake device to a non-braking state, and opening or shutting the shutter curtain by manually operating a handle or the like.

There are known electric-powered shutter apparatuses, such as disclosed in, e.g., Japanese Unexamined Patent Publication No. 7-180457, which are provided with a balance tension device which builds tension in accordance with rotation of the winding drum from which the shutter curtain is rolled off, thus balancing the weight of the shutter curtain itself, and also provided with an interruptive clutch in the power transmission path from the electric motor to the winding drum, so that the interruptive clutch is disengaged when electric current to the electric motor is disconnected. In this manner, the power transmission of the electrical motor is disengaged, consequently allowing the shutter curtain to be directly opened and shut by hand, since it is balanced by the balancing tension device.

However, this kind of electric-powered shutter apparatus not only needs the costly electromagnetic clutch arrangement for the interruptive clutch, but wiring to the interruptive clutch becomes necessary, making it a complicated construction. Herein is a problem to be solved by the present invention.

To solve the problem of the prior configuration, a rotational clutch (torque limiter), which slips and disengages transmission of power when a load exceeding a certain level is placed thereupon, may be employed instead of the electromagnetic clutch. However, when opening or shutting the shutter curtain with this arrangement in the event that the electrical power is disconnected, the extra force necessary for rotating the motor which is disconnected from electric current increases the load so that the shutter curtain becomes heavier for opening or closing operation. Such a tendency becomes more pronounced the greater the reducing gear ratio of the motor drive force. Herein is another problem to be solved by the present invention.

OBJECT AND SUMMARY OF THE INVENTION

Accordingly, it is an object of the present invention to solve the above discussed problems with the described related art.

The present invention is an electric-powered shutter apparatus for a building comprising certain particular structure. A shutter curtain is provided which opens and closes an opening. A winding drum is mounted to wind the shutter curtain. A driving means rotates the winding drum in the forward and reverse directions. A balance tension device is provided which builds tension in accordance with dispensing of the shutter curtain from the winding drum. The driving means includes an electric motor which drives in the forward and reverse directions according to driving commands from a control board. A uni-directional rotary clutch is provided which is set so as to slip when the load of rotation in at least the direction of curtain feeding exceeds a certain load, but does not comprise a braking device.

Thus, the shutter curtain may be stopped at any desired position due to the balance tension device, but does not require a braking device, thus achieving simplification of the construction and lowering of costs.

In the present invention as described above, in the event that the load at which the single-directional rotary clutch slips is greater than the load for forcibly rotating the electric motor when disconnected from electric current, the balancing device is balanced against the sum of the weight of the shutter curtain that has been fed and the load for forcibly rotating the electric motor disconnected from electric current. In this manner, the balance tension device has stored force for providing extra operating force for forcibly rotating the electric motor. Consequently, the shutter apparatus can be opened or shut manually with little effort.

BRIEF DESCRIPTION OF THE DRAWINGS

The above and other objects and the attendant advantages of the present invention will become readily apparent by reference to the following detailed description when considered in conjunction with the accompanying drawings wherein:

FIG. 3 is a partial cross-sectional side view of the clutch device;

FIG. 4 is a cross-sectional diagram along line X—X in FIG. 3, illustrating the state in which the clutch is engaged to motive power; and FIG. 5 is a cross-sectional diagram along line X—X in FIG. 3, illustrating the state in which the clutch is disengaged from motive power.

DESCRIPTION OF THE PREFERRED EMBODIMENT

Figure 1:
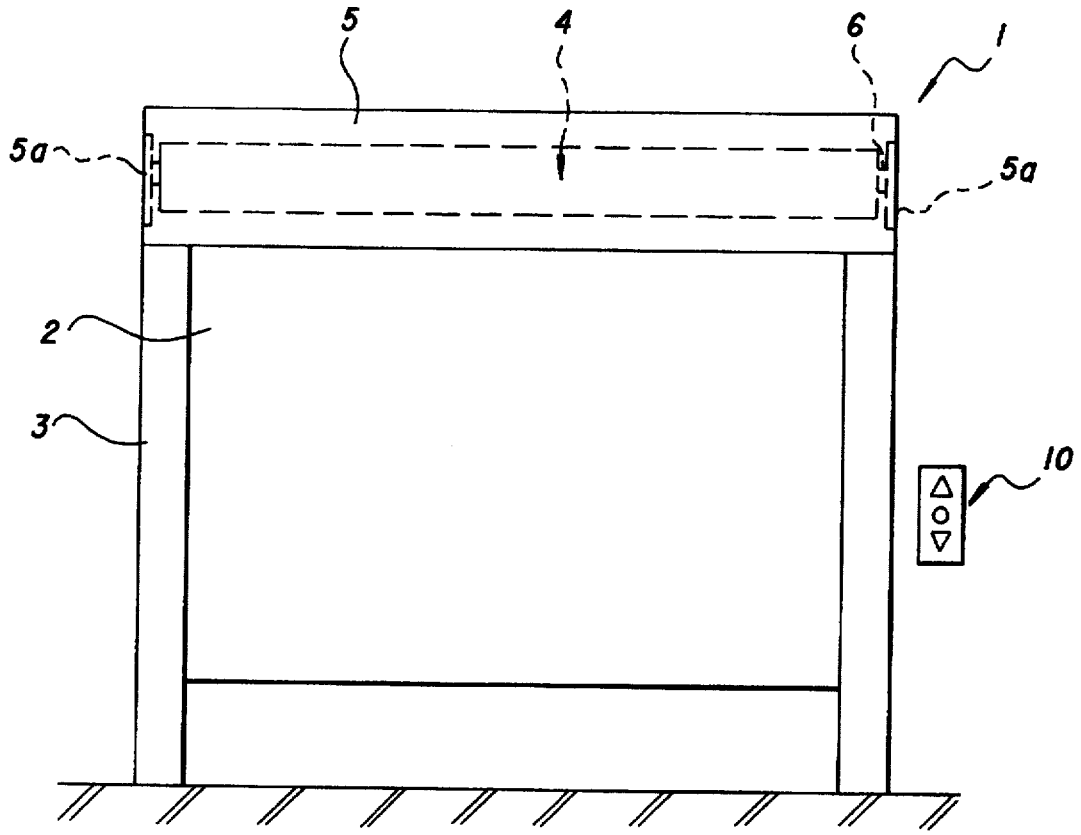
FIG. 1 is a schematic frontal view of the shutter apparatus according to the present invention.
Figure 2:
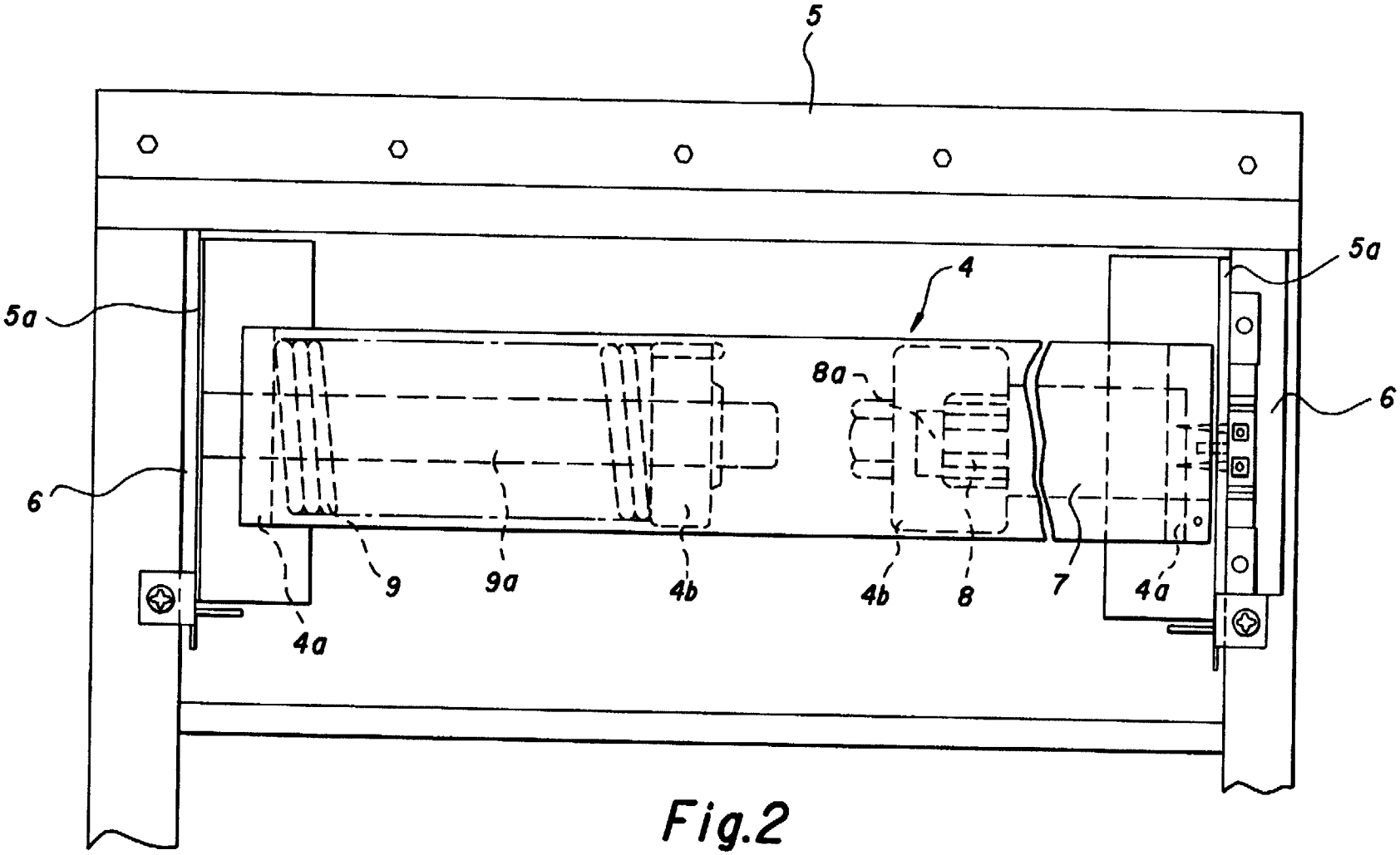
FIG. 2 is a frontal view of the principal mechanism.

An embodiment of the present invention will now be described with reference to FIGS. 1 through 5. In the Figures, a shutter apparatus 1 for a building is mounted to cover an opening in the building. This shutter apparatus 1 is the same as conventional art in respect to being comprised of a shutter curtain 2, guide rails 3 which engage and guide both edges of the shutter curtain 2, a shutter case 5 housing a winding drum 4 for winding the shutter curtain 2, and the like.

The winding drum 4 is cylindrical in form and is integrally provided with multiple wheels 4*a* and 4*b* on the inner periphery thereof. A case bracket 5*a* of the shutter case 5 is provided with a fixed supporting shaft 6 fixed thereto. The wheels 4*a* on either far end are journaled so that the winding drum 4 is supported to freely rotate in both forward and reverse directions. The driving device comprises an electric motor 7 which drives in both forward and reverse directions, and a single-directional rotary clutch device 8 for interrupting motor drive force from the electric motor 7. The output shaft 8*a* of this clutch device 8 is linked to central wheels 4*b*, so that when the electric motor 7 drives, the winding drum 4 rotates in accordance with the driving thereof, thus facilitating control of opening and closing of the shutter apparatus 1 by the electric motor.

The clutch device 8 is constructed as shown in FIGS. 3–5. The clutch device 8 comprises a casing 8*b* which has a cylindrical form with the output shaft 8*a* integrally formed at one end thereof, and an input shaft 7*a* linked in an interlocking manner to the motor shaft i.e., the motor output shaft of the electric motor 7 is journaled to the other end of the casing 8*b* so as to be rotatable. Oscillating shafts 8*c* are fixed on the inner periphery of the casing 8*b* facing respective ratchet teeth 7*b* formed on the outer periphery of the input shaft 7*a*, with the base portions of engagement members 8*d* being journaled by the oscillating shafts 8*c* in such an arrangement that the leading edges of the engagement members 8*d* are movable so as to engage the ratchet teeth 7*b* or be freed therefrom. Further, the engagement members 8*d* are positioned to face the center direction of engagement with the ratchet teeth 7*b* by clutch tension devices 8*e*, each having a base fixed to the inner periphery of the casing 8*b*. Accordingly, when the input shaft 7*a* rotates in the direction of the Arrow A illustrated in FIG. 4, i.e., when the electric motor 7 drives in a direction to open the shutter curtain 2, the engagement members 8*d* are continuously engaged against the primary engagement planes 7*c* of the ratchet teeth 7*b*, so that the casing 8*b* rotates integrally with the input shaft 7*a* without slipping, thus engaging the motive power of the rotation of the output shaft 8*a*. In contrast thereto, when the input shaft 7*a* rotates in the direction opposite to the Arrow A, i.e., when the electric motor 7 drives in a direction to close the shutter curtain 2, the engagement members 8*d* are engaged against the secondary engagement planes 7*d* of the ratchet teeth 7*b* so as to engage motive power. However, the clutch device 8 is configured such that in the event that the drive load of the input shaft 7*a* exceeds the slippage resistance of the clutch tension device 8*e*, the engagement members 8*d* are pressed outward to the peripheral side against the slippage resistance of the clutch tension devices 8*e*, to the extent of crossing over the ratchet teeth 7*b* as illustrated in FIG. 5, thus disengaging the engagement between the engagement members 8*d* and the ratchet teeth 7*b* so that the motive power is disengaged, i.e., in a state of slippage.

Moreover, the slippage resistance of the clutch tension devices 8*e* is set so as to be greater than the load necessary to forcibly rotate the electric motor 7 in the state of the electric motor 7 being disconnected from electric current.

At the other half of the winding drum 4, a supporting shaft 9*a* is provided. One end of the supporting shaft 9*a* is rotatably journaled to the fixed supporting shaft 6, and the other end is fixed to a center wheel 4*b*. A coil-type balance tension device 9 is wrapped around the supporting shaft 9*a* with slack. One end of the coil-type balance tension device 9 is linked and fixed to the fixed supporting shaft 6, and the other end is linked and fixed to the center wheel 4*b*. The stored force of the balance tension device 9 according to the present invention does build according to rotation of the winding drum 4 in the direction of shutting the curtain, but the stored force thereof is not balanced only against the weight of the shutter curtain 2 fed from the aforementioned winding drum 4. Rather, the stored force is balanced against the weight of the shutter curtain in addition to the load required to forcibly rotate the electric motor 7 when electric current is not supplied thereto. This arrangement does not incorporate a braking device.

Next, the opening and closing operation of the shutter apparatus 1 according to the present embodiment will be described. First, opening and closing operation in the event that electric current is supplied to the electric motor 7 is conducted as follows: Electric power is supplied to the electric motor in response to operation of an opening/closing operation push-button switch 10, thereby rotating the electric motor 7 in a forward or reverse direction. This winds the shutter curtain 2, i.e., opening, and feeds the shutter curtain 2, i.e., closing of the shutter curtain 2. When the shutter curtain 2 is being fed, as described above, force is stored in the aforementioned balance tension device 9. During feeding operation of this shutter curtain 2, in the event that the lower edge of the curtain strikes against an obstructing object, motion of the shutter curtain 2 is thereby restricted in the closing direction, while the electric motor 7 continues driving. The present embodiment is designed so that when the driving load of the electric motor 7 exceeds the load level at which the clutch device 8 slips, the clutch tension devices 8*e* slip in this situation, consequently causing feeding of the shutter curtain 2 to be stopped by striking the obstructing object with only the smaller force necessary to cause the clutch tension devices 8*e* to slip, rather than the greater force of the driving load of the electric motor 7. On the other hand, the arrangement allows for manual opening and closing of the shutter curtain 2 in the event of emergency such as power outage, by means of pushing up or pulling down the shutter curtain 2 by hand.

According to the above-described embodiment of the present invention, the opening and closing operation of the shutter curtain 2 is conducted automatically by electrical operation when electrical current is supplied to the electric motor 7. In this situation, the clutch device 8 slips when the shutter curtain 2 strikes an obstructing object, so that the force of the shutter curtain 2 striking the obstructing object is the force necessary to cause the clutch device 8 to slip, rather than the greater force of the driving load of the electric motor 7.

On the other hand, when the electric motor 7 is not supplied with electric current, the shutter curtain 2 can be pushed up or down manually, thus allowing for easy manual opening and closing in the event of an emergency such as power outage. While this arrangement does not include a braking device, the shutter curtain 2 can be stopped at any desired position due to the stored force of the balance tension device 9. As a result, the driving means can be simply constructed of only an electric motor 7 with reducing gear mechanism and a clutch device 8. In addition to thus achieving a compact structure of the members, the cost of the apparatus can be reduced. Moreover, the clutch device 8 according to the present invention is mechanical rather than electrical, eliminating the need for additional wiring, and further achieving lowering of costs.

Moreover yet, according to this arrangement, the stored force of the balance tension device 9 is not balanced only against the weight of the shutter curtain 2 fed from the winding drum 4, rather, the stored force is balanced against the weight of the shutter curtain in addition to the load required to forcibly rotate the electric motor 7 when electric current is not supplied thereto. Accordingly, the shutter curtain 2 can be lightened, and moreover, in the aforementioned event of opening or closing the shutter curtain 2 manually, the load for forcibly rotating the electric motor 7 disconnected from electric current is supplied by the stored force of the balance tension device 9, so there is no need for exerting extra strength for opening and closing operations as with known apparatuses wherein only balancing against the weight of the shutter curtain 2 is employed. Consequently, the shutter apparatus can be opened or shut manually with little effort.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

What we claim is:

1. An electric-powered shutter apparatus for mounting to a building, comprising:

a shutter curtain which opens and closes an opening;

a winding drum winding said shutter curtain;

driving means for rotating said winding drum in forward and reverse directions to feed and close the shutter curtain; and a balance tension device which stores force in accordance with rotation of the winding drum in feeding of the shutter curtain from said winding drum;

wherein said driving means comprises an electric motor which drives in forward and reverse directions according to driving commands from a control board, and a rotary clutch set to slip when a load of rotation in at least a direction of curtain feeding exceeds a certain feeding load, wherein said rotary clutch has a slip load at which said rotary clutch slips, said slip load is greater than a load for forcibly rotating said electric motor when disconnected from electric current, and said balance tension device has said storing force set to balance against a sum of the weight of the shutter curtain which has been fed and said load for forcibly rotating said electric motor disconnected from electric current.

* * * * *